United States Patent [19]

Ploussios

[11] Patent Number: 4,523,160

[45] Date of Patent: Jun. 11, 1985

[54] WAVEGUIDE POLARIZER HAVING CONDUCTIVE AND DIELECTRIC LOADING SLABS TO ALTER POLARIZATION OF WAVES

[76] Inventor: George Ploussios, 4 Hackney Cir., Andover, Mass. 01810

[21] Appl. No.: 490,346

[22] Filed: May 2, 1983

[51] Int. Cl.[3] ..... H01P 1/161

[52] U.S. Cl. ..... 333/21 A; 333/248

[58] Field of Search ..... 333/21 A, 21 R, 156, 333/248, 239, 251; 343/756, 772

[56] References Cited

U.S. PATENT DOCUMENTS

| | | | |
|---|---|---|---|
| 2,441,574 | 5/1948 | Jaynes | 333/21 A X |
| 2,764,743 | 9/1956 | Robertson | 333/251 |
| 3,758,882 | 9/1973 | Morz | 333/21 A |
| 4,303,900 | 12/1981 | Tourneur | 333/239 |
| 4,344,048 | 8/1982 | Morz | 333/21 A X |
| 4,443,800 | 4/1984 | Gaglione | 333/21 A X |
| 4,458,229 | 7/1984 | Landry et al. | 333/248 |

OTHER PUBLICATIONS

La Page, et al., "Westford Antenna System", *IEEE Proceedings*, May 1964, p. 591.

Kazantsev et al., "Rectangular Waveguides of the Hollow Dielectric Class", 9th *European Mircowave Conf. Proceedings*, Brighton, Eng., 17-20, Sept. 1979.

*Primary Examiner*—Eugene R. Laroche

*Assistant Examiner*—Benny T. Lee

*Attorney, Agent, or Firm*—E. Thorpe Barrett

[57] ABSTRACT

The invention is embodied in a waveguide polarizer of the kind arranged to alter the propagation modes of an incident wave to produce elliptical or circular polarization. The phase shift is produced by the simultaneous use of dimensional perturbation and dielectric loading distributed along a waveguide section. Embodiments are illustrated using square, circular and crossed waveguide sections. The use of relatively light, symmetrical and continuous loading provides improved performance over that which can be attained by discrete element phase shifters or those that make use of only a single kind of loading.

3 Claims, 11 Drawing Figures

WAVEGUIDE POLARIZER HAVING CONDUCTIVE AND DIELECTRIC LOADING SLABS TO ALTER POLARIZATION OF WAVES

BACKGROUND OF THE INVENTION

1. Field of the Invention

This invention relates to waveguide polarizers, that is, to sections of waveguide arranged to alter the propagation modes of a wave so as to produce elliptical or circular polarization.

2. Description of the Prior Art

Many arrangements have been proposed for altering the polarization of waves as they are propagated through sections of waveguides. The prior art provides numerous examples of waveguide polarizers in which a waveguide that can support two spacially orthogonal independent waveguide modes is provided with discrete inductive or capacitive loading, dielectric loading or dimensional perturbations to introduce differential phase shift between the two orthogonal components. Such a polarizer is frequently used in circularly polarized antenna systems in which the waveguide polarizer section is interposed between a horn radiator and a waveguide section that supports a linear polarized wave.

U.S. Pat. No. 2,607,849 to Purcell et al. describes a waveguide for producing, from plane-polarized components, circular polarization of various degrees of elliptical polarization by means of slabs or plates of solid dielectric material extending lengthwise in the waveguide. The incident wave transmitted to the waveguide is polarized so that its electric vector is at an oblique angle with respect to the surface of a dielectric plate extending across and longitudinally within the waveguide. The component waves having electric vectors oriented in a plane parallel with the surfaces of the dielectric plate will be propagated at a velocity different from those having electric vectors oriented perpendicularly to the surfaces of the plate. This difference in velocity arises because the plate has a relatively smaller effect upon an electric field directed perpendicularly to the surfaces of the plate whereas it has relatively large effect upon an electric field in which the electric vector lies in a plane parallel with the surfaces of the plate. The length of the plate is selected to provide the desired ellipicity of polarization.

A somewhat similar arrangement is shown in U.S. Pat. No. 2,546,840 to Tyrrell that makes use of one or more metal fins attached within the waveguide so as to possess both radial and longitudinal extent. The effect of the fins on wave transmission depends upon their orientation with respect to the polarization of the waves. Such a fin alters the phase velocity and critical cut-off frequencies for polarization or orientation of a field parallel thereto, but has no effect on corresponding perpendicular polarizations. The fin is dimensioned and shaped to provide the desired degree of phase shift. The phase shift section is matched to the main waveguide over a broader band of frequencies by the use of tapered or reduced cross sections formed on the fin.

U.S. Pat. No. 2,599,753 to Fox shows a fin formed by dielectric material extending partially or completely across the waveguide. Broader band operation is said to be achieved by capacitance reactance screws extending into the waveguide in the region of the fin and so oriented and adjusted as to provide a compensation and neutralizing action. The end portions of the fin are either provided with a V-shaped notch or a tapered pointed section to minimize discontinuities.

U.S. Pat. No. 2,858,512 to Barnett shows a phase shifter making use of fins of dielectric material positioned in a circular section of waveguide that, by means of flange connections, can be rotated relative to the adjacent waveguide sections for mechanical adjustment of the phase shift.

U.S. Pat. No. 2,933,731 to Foster describes the use of either a dielectric strip, metal fins or a metal plug in much the same manner as the earlier prior art to achieve circular polarization. Also disclosed is the use of a section of waveguide elliptical in cross section to replace the use of either the dielectric strip, the fins or the plug. The elliptical cross section may be obtained by distortion of a section of circular waveguide.

U.S. Pat. No. 3,031,661 to Moeller et al. shows an arrangement interposed between a square waveguide and a radiating horn to provide circular polarization. A slab of dielectric material is positioned in a circular section of waveguide that is mechanically rotatable to alter the orientation of the dielectric slab. The radiating horn is provided with a series of discrete inwardly extending fins on each of the four sides that are said to produce horn patterns independent of polarization.

U.S. Pat. No. 4,141,013 to Crail et al. discloses various arrangements of conductive fins (irises) extending from the waveguide walls. Also described is a horn having spaced fins (irises) extending from opposite corners of the horn. Each pair of conductive fins imparts a rotation or circular polarization in a linear wave propogating past each pair.

SUMMARY OF THE INVENTION

The present invention, which is concerned only with the polarizer section of a waveguide system, uses a continuous dual loading technique comprising both symmetrical dielectric loading and dimensional perturbation, each of which acts on both orthogonal components to provide improved performance over that which can be attained by the use of either dielectric loading or the dimensional perturbation alone. The simultaneous use of both techniques makes possible a circular or elliptical polarizer with greater bandwidth; one that is shorter in physical length from that required with a singly loaded device; and one that is less susceptible to higher order mode generation than are discrete element phase shifters (such as those with spaced irises) because of the relatively light, symmetrical and continuous loading.

DESCRIPTION OF THE PREFERRED EMBODIMENTS

Figure 1:
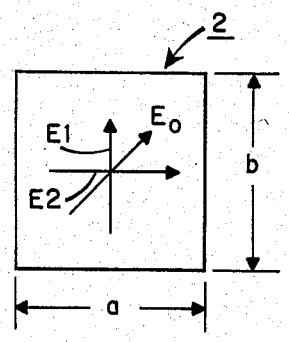
FIG. 1 is a cross section of a conventional waveguide embodying the invention.
Figure 3:
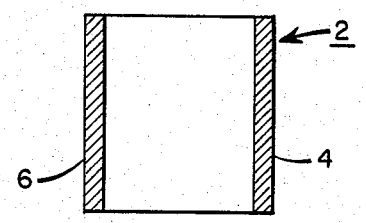
FIG. 3 is a cross section of a similar waveguide section in which the effective horizontal dimension has been decreased by the insertion of metal loading elements.

To illustrate the elements of the invention, consider a waveguide, generally indicated at 2, having a square cross section as shown in FIG. 1 which is capable of supporting orthogonal electric components $E_1$ and $E_2$ and transmitting a linear wave $E_0$ of which $E_1$ and $E_2$ are components without change in polarization. If the horizontal dimension "a" is reduced by an amount equal to 2d where d is equal to the thickness of each of two metal loading slabs 4 and 6, as indicated in FIG. 3, the cutoff frequency of $E_1$ is increased resulting in the differential phase shift shown by the curve "a" in FIG. 5. Note that the phase shift per unit length resulting from the dimensional perturbation increases rapidly with decreasing frequency. The horizontal width of the waveguide may be effectively reduced by the insertion of metal slabs, as illustrated at 4 and 6 in FIG. 3, or by fabricating the waveguide to a narrower width.

Figure 2:
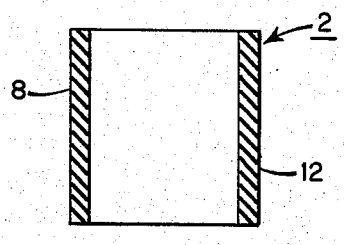
FIG. 2 is a cross section of a similar waveguide having a pair of symmetrical dielectric slabs positioned along opposite walls of the guide.

Instead of the dimensional perturbation illustrated by FIG. 3, two dielectric slabs 8 and 12 may be placed in the waveguide along opposite walls as illustrated in FIG. 2. These dielectric slabs decrease the cut-off frequency of $E_2$ resulting in the phase shift curve shown at "b" in FIG. 5. The minimum phase shift indicated by this curve is independent of the dielectric constant or thickness of the slabs 8 and 12.

Figure 5:
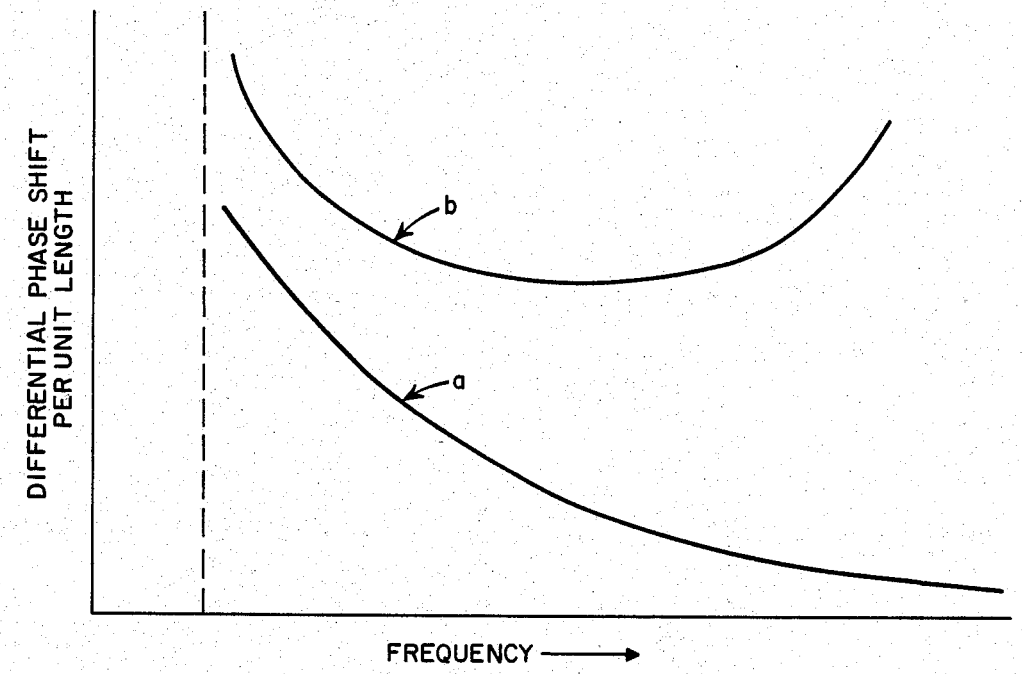
FIG. 5 is a chart having one curve illustrating differential phase shift per unit length as a function of dimensional perturbation, and a second curve showing the phase shift as a function of the thickness of dielectric loading slabs.

The use of both dimensional perturbation and dielectric loading results in a combination of the two curves of FIG. 5 making possible an improved waveguide polarizer as previously discussed. If the effective width of the waveguide is decreased. as by the use of metal slabs 4 and 6, the two curves "a" and "b" are added to provide more uniform rate of phase shift vs frequency over an extended range. If the effective width of the waveguide is increased, the two curves "a" and "b" are subtracted. This flattens the frequency curve at lower frequencies or gives a monotonically increasing phase shift vs. frequency curve.

Figure 4:
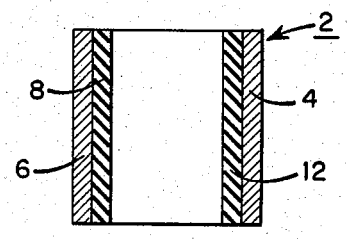
FIG. 4 is a cross section of a waveguide in which the horizontal dimension has been reduced as shown in FIG. 3 and to which dielectric loading has been added as shown in FIG. 2.

FIG. 4 illustrates the simultaneous use of both of these techniques. The metal loading slabs 4 and 6 are positioned along opposite walls of the waveguide 2 and form two inner conductive surfaces separated by a distance less than the orthogonal distance between the upper and lower (as seen in FIG. 4) conductive surfaces of the waveguide. The dielectric slabs 8 and 12, which may be formed, for example, from polystyrene, are secured to the respective inner surfaces of the metal loading slabs 4 and 6 or, alternatively, they may be affixed to the upper and lower walls of the waveguide.

The waveguide may be of square or other cross-sectional shape in accordance with the particular application and the characteristics desired. The term rectangular as used herein includes shapes having either equal or unequal sides.

Figure 7:
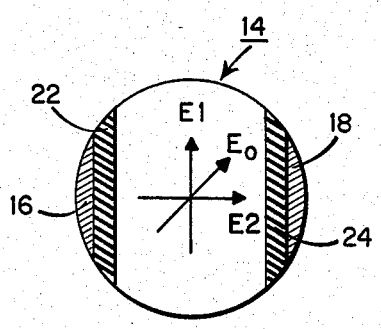
FIG. 7 is a cross-sectional view of the guide shown in FIG. 6.
Figure 6:
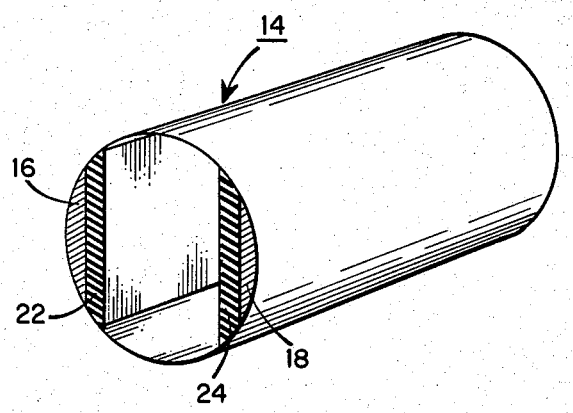
FIG. 6 is a perspective view of a waveguide polarizer embodying the present invention in which both dimensional perturbation and dielectric loading are used to achieve phase shift in a circular guide.

An alternative construction is shown in FIGS. 6 and 7 in which a circular waveguide section, generally indicated at 14, is provided with two metal loading slabs 16 and 18 which in cross section form a segment of a circle having a diameter equal to the inner diameter of the waveguide 14 and are positioned in face-to-face relationship on opposite sides of the waveguide. The resulting internal shape of the waveguide is thus distorted from being truly circular into a somewhat elliptical outline in which the horizontal dimension is now less than the vertical dimension as viewed in FIG. 7. The term annular is used herein to include both circular and elliptical shapes in which the circular shape has been distorted to produce the desired phase shift effect. The same result could obviously be produced by forming the wall of the waveguide 14 into the desired dimensional configuration. However, cost factors and considerations of coupling the polarizer section to conventional circular waveguide, usually make it desirable to insert the metal slabs rather than modifying the outer shape of the waveguide section. The metal slab inserts need not be solid, but may comprise either a hollow structure or simply a plane metal strip extending between spaced lines on the waveguide shell.

To provide the dielectric loading, two slabs 22 and 24 of dielectric material, such as polystyrene, are each positioned adjacent the inner surface of one of the metal loading slabs 16 and 18. The dimensions and thickness of the metal and dielectric loading slabs, and the length of the polarizer section, are selected to produce the desired degree of polarization.

Figure 9:
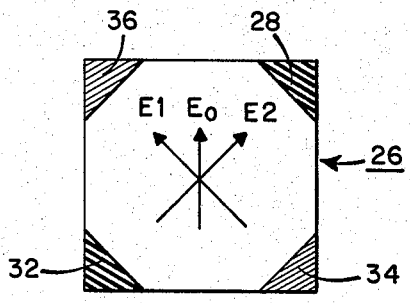
FIG. 9 is a section through the guide shown in FIG. 8.
Figure 8:
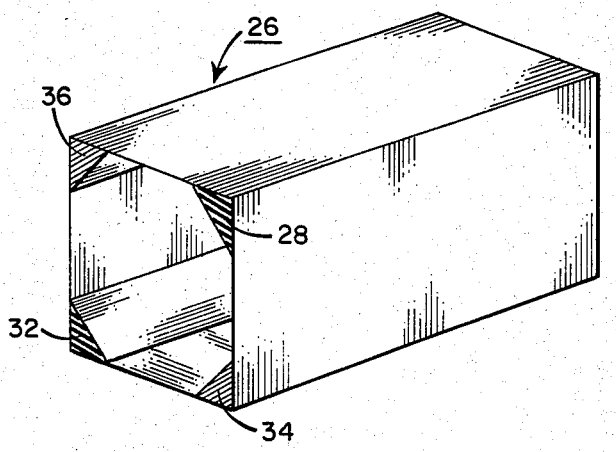
FIG. 8 is a perspective view in which the invention is embodied in a square waveguide with diagonal loading.

The dimensional perturbation and dielectric loading may be arranged to provide diagonal loading in a rectangular waveguide as illustrated in FIGS. 8 and 9. A square section of waveguide, generally indicated at 26, is provided with two slabs 28 and 32 of triangular cross section formed of dielectric material and fitted into opposite corners of the waveguide. Metal loading in the remaining two corners of the waveguide is provided by two lengths of metal slabs 34 and 36 of triangular cross section. The solid metal slabs, which serve only to reduce the diagonal dimension of the waveguide, may be replaced with hollow structures of the same shape or by metal plates welded to the sidewalls or otherwise secured across the corner spaces to provide the same conductive inner surfaces as the metal slabs 34 and 36.

In this example, the incident wave is polarized vertically with the component E-vectors directed diagonally as indicated by the arrows in FIG. 7.

Figure 11:
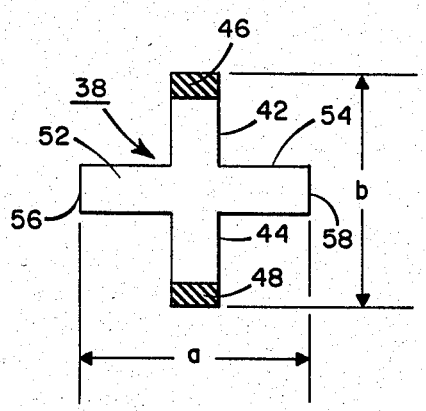
FIG. 11 is a cross section through the waveguide of FIG. 10.
Figure 10:
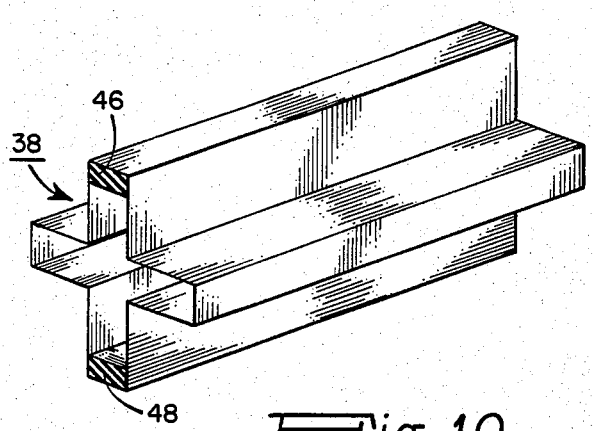
FIG. 10 is a perspective view of a crossed waveguide with loading by means of dimensional perturbation and dielectric loading.

FIGS. 10 and 11 show the application of dimensional perturbation and dielectric loading to a crossed waveguide section, generally indicated at 38. Such a waveguide section has four arms of rectangular cross section extending from a central area at angles of ninety degrees so that the cross section is in the shape of a cross as shown by FIG. 11. A first pair of these arms 42 and 44 are loaded by means of dielectric slabs 46 and 48 which extend respectively along opposing end surfaces of the arms 42 and 44. The other pair of arms 52 and 54 are formed with the desired distance between the opposing end surface 56 and 58 either greater or less than the distance between the corresponding conductive surfaces of the arms 42 and 44, that is, the distance indicated by the arrow "a" in FIG. 11 is different from the distance indicated by the arrow "b". Whether the distance "a" or the distance "b" is greater is a function of the design requirements as discussed above in connection with the curves of FIG. 5.

In all of the above examples, the dielectric and metallic inserts present small discontinuities at each end of the polarizer. These discontinuities will not usually have a significant effect on the performance of the polarizer. However, in very high performance systems, or systems of special design, this discontinuity may be important. In that event, the effect can be minimized by using a tapered section, or small discrete steps, at each end leading to the full thickness of the insert. Designs using the principles of this invention, without tapers or steps, have resulted in bandwidths of up to 2:1 with ellipticity less than 1 db.

I claim:

1. A waveguide polarizer comprising a waveguide of round cross section having therein a center portion, a pair of metal slabs forming opposing plane conductive surfaces, and a pair of spaced opposing dielectric slabs symmetrically positioned and extending along said waveguide, said center portion being free of obstruction.

2. A waveguide polarizer including a waveguide of rectangular cross section having a pair of spaced opposing dielectric slabs positioned within and extending along and diagonally across a first pair of opposing corners of said waveguide section, and a pair of spaced opposing conductive loading slabs extending linearly along said waveguide section and diagonally across a second pair of opposing corners arranged to produce a dimensional perturbation of said waveguide section, said center portion of said waveguide section being free of obstructions.

3. The method of making a polarizing waveguide comprising the steps of providing a waveguide section having internal conductive surfaces defining a center portion free of obstructions and capable of propagating two orthogonal waves, positioning two conductive loading slabs respectively along opposing internal surfaces of said waveguide section, and positioning first and second slabs of dielectric material spaced from and opposite each other and extending along opposing internal surfaces of said waveguide section.

* * * * *